United States Patent [19]

Kitchin

[11] Patent Number: 4,526,860

[45] Date of Patent: Jul. 2, 1985

[54] PHOTOGRAPHIC PROCESS

[75] Inventor: Jonathan P. Kitchin, Ware, England

[73] Assignee: Minnesota Mining and Manufacturing Company, St. Paul, Minn.

[21] Appl. No.: 460,474

[22] Filed: Jul. 28, 1983

[51] Int. Cl.[3] ..... G03C 5/32

[52] U.S. Cl. ..... 430/373; 430/393; 430/376; 430/380; 430/943

[58] Field of Search ..... 430/393, 376, 373, 380, 430/943

[56] References Cited

U.S. PATENT DOCUMENTS

| | | | |
|---|---|---|---|
| 4,045,226 | 8/1977 | Hara et al. | 430/373 |
| 4,088,486 | 5/1978 | Bissonette | 430/393 |
| 4,094,682 | 6/1978 | Fujiwhara et al. | 430/373 |

FOREIGN PATENT DOCUMENTS 1268126 3/1972 United Kingdom .

*Primary Examiner*—Won H. Louie

*Attorney, Agent, or Firm*—Donald M. Sell; James A. Smith; Mark A. Litman

[57] ABSTRACT

A photographic process for providing a silver image enhanced by the presence of a dye in which a substantially insoluble silver salt is formed from fixed silver prior to color development in the presence of a color coupler or a dye-forming developing agent.

10 Claims, 3 Drawing Figures

PHOTOGRAPHIC PROCESS

BACKGROUND OF THE INVENTION

1. Field of the Invention

This invention relates to a photographic process in which an image-wise exposed silver halide photographic element is developed so that the image produced is enhanced by the presence of a dye.

2. Background of the Prior Art

To reduce the cost of photographic films, it is necessary to reduce the silver content thereof while maintaining the sensitivity of the film and the image density obtained upon processing.

In the conventional black and white photographic process, silver halide which has been image-wise exposed to light is chemically reduced by a developer solution to give an image composed of metallic silver in the exposed areas. In color photography the exposed silver halide is reduced by a developing agent which, in its oxidized form, is capable of reacting with certain organic compounds to form dye images. These compounds, which may be present in the coated photographic element or in the developer solution, are known as color couplers. In color photography the silver image is produced as a by-product and is removed by oxidation in a subsequent bleach or bleach-fix bath.

In such a color development process the quantity of dye formed in the image areas is strictly governed by the quantity of silver halide which is reduced by the developing agent. Either two or four atoms of silver are required to produce one molecule of dye, depending upon the particular type of color coupler.

Various methods have been proposed in which the ratio of the dye formed to the silver required is increased, thereby reducing the quantity of silver required to produce an image density comparable to that in the conventional photographic process. The silver image formed by conventional development may be employed as a catalyst for the oxidation of a color developing agent by an oxidant, referred to as an "amplifying agent". In this way, many molecules of a dye may be formed for each atom of silver present.

There are several known photographic processes employing amplifying agents including cobalt (III) hexa-amine salts, chlorites, aryl iodoso compounds and hydrogen peroxide. The amplifying agent having the highest activity is hydrogen peroxide, although there are several disadvantages with this compound which have prevented its use in commercial photographic processes.

British Patent Specification No. 1 268 126 discloses a process in which a silver halide film which contains an excess of color coupler is developed in a standard color developer solution. The film is then transferred to a bath containing aqueous hydrogen peroxide in which the color developing agent is oxidized by the hydrogen peroxide in those areas where developed silver halide is present to catalyze the reaction. The oxidized developer then reacts with color coupler to form a dye enhanced image. One problem with this process is that the undeveloped silver halide in the non-image areas also catalyzes the oxidation of color developer by hydrogen peroxide, resulting in a high background fog. U.S. Pat. Nos. 4,045,225, 4,045,226, 4,069,050, 4,062,684 and 4,113,490 disclose possible solutions to this problem in which compounds which deactivate the undeveloped silver halide, thereby reducing the fog, may be added to the coated layer.

A further disadvantage with the hydrogen peroxide amplification process is that the catalytic action of the developed silver may be very easily poisoned by a variety of substances including thiosulfate fixer and iodide ion. Also, large grained silver images such as those produced by medical X-ray film do not behave as very active catalysts for amplification. The activity of the silver image as a catalyst appears to be inversely related to the particle size of the silver.

U.S. Pat. No. 4,088,486 discloses a photographic process in which the silver image is replaced by a cobalt (II) image. The cobalt (II) acts as a catalyst for hydrogen peroxide amplification and is not subject to poisoning by thiosulfate fixer. Accordingly, the developed film may be fixed prior to amplification thereby reducing the background fog caused by silver halide in the non-image areas. Furthermore, the cobalt (II) image is not subject to grain size effects on its catalytic activity. However, a disadvantage of this cobalt amplification process is that it may not generally be used in combination with soluble color couplers since these compounds tend to react with the cobalt catalyst. Various other methods of enhancing the image density of silver halide images which involve initial bleaching of the silver image are known. In one process the bleached image is simply redeveloped by a black and white developer furnishing a slightly enhanced image. In another process the bleached image may be treated with a solution which causes the image-wise deposition of a pigment in a double decomposition reaction. In a further process a color photographic material is color developed, bleached and then color developed again thereby yielding twice the normal quantity of dye. All of these methods give a final image density which is strictly governed by the quantity of silver present since the reactions involved are completely stoichiometric.

It is an aspect of the present invention to provide a photographic process in which silver images may be enhanced by the formation of a dye without the significant problems attendant in the prior art.

BRIEF DESCRIPTION OF THE INVENTION

According to the present invention there is provided a photographic process for the development of an image-wise exposed silver halide photographic element which comprises treating said element with a developer solution to form a silver image, treating the developed element with fixer to remove undeveloped silver halide, oxidizing the fixed silver image to form a substantially insoluble silver salt and thereafter treating the element with:

(i) color developer in the presence of a color coupler, or (ii) a dye-forming developing agent, and hydrogen peroxide to form a dye in said image areas.

The present invention makes use of the bleached silver image for the formation of dye in a catalytic process yielding a much higher degree of amplification than in those processes in which the final image density is governed by the quantity of silver present. Thus, the silver content of photographic elements may be substantially reduced while retaining the same image density upon processing in accordance with the invention.

The process of the invention may provide an amplification equal to or greater than that achieved by the process disclosed in U.S. Pat. No. 4,088,486 and may also use soluble color couplers. Furthermore, the method of the invention may be used to produce amplified images having low background fog from iodobromide emulsions.

The process of the invention is applicable to both positive and negative photographic systems. In a negative system the light or transparent areas on the photographic element represent the dark tones of the original and the dark or opaque areas on the photographic element (i.e., those regions exposed to light) represent the light tones of the original. In a positive photographic system the dark areas on the photographic element represent the dark tones of the original. The following description and Examples are directed towards negative photographic systems, although it will be readily appreciated that the technology of the invention may be applied to conventional positive photographic systems.

DETAILED DESCRIPTION OF THE INVENTION

Figure 1:
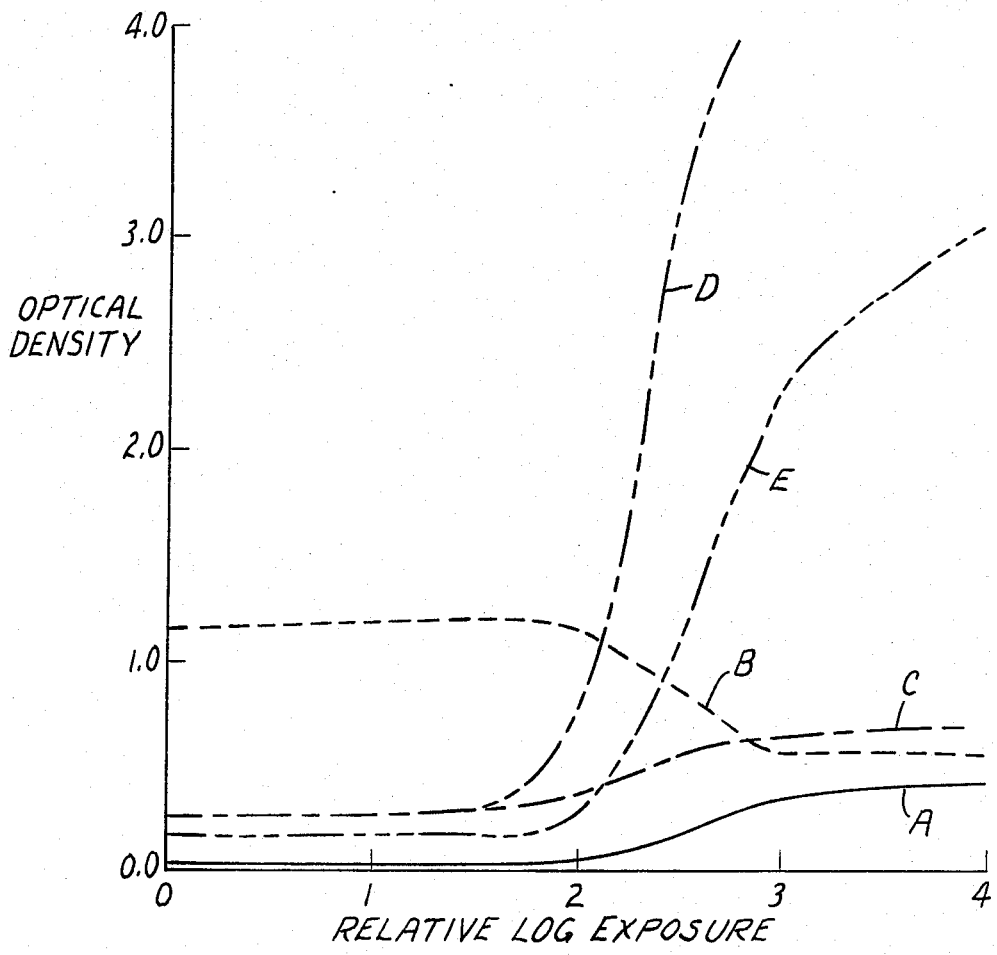
FIG. 1 shows an optical density (D) versus the logarithum of the energy of exposure (log E) curves comparing the product of the invention against other products.

The first stage in the process of the invention involves the development of an image-wise exposed silver halide photographic element by a conventional black and white or color developer. Suitable developing agents and processing conditions are well known in the art.

In the known hydrogen peroxide amplification process, the silver image formed at this stage would be treated with the amplifying bath containing hydrogen peroxide. In the case of an iodobromide emulsion, the silver image formed at this stage is a very poor catalyst for amplification by hydrogen peroxide. Furthermore, amplification by hydrogen peroxide at this stage results in high background fog owing to undeveloped silver halide in the non-image areas unless the undeveloped silver halide is "deactivated".

The second stage of the process of the invention is to fix the developed image using a conventional silver halide fixer. This treatment results in the undeveloped silver halide being removed (e.g., dissolved and the solution in which it is dissolved, removed) from the non-image areas. Amplification by hydrogen peroxide at this stage shows very little effect since the silver image is thoroughly poisoned by the fixer and even after prolonged washing the catalytic effect of the silver image is inhibited.

The third stage of the process of the invention is the oxidation of the fixed silver image to a substantially insoluble silver salt. The conventional bleaching solutions known in the photographic art are suitable for this stage. The anion of the silver salt which is formed should have a minimal inhibiting effect on the subsequent hydrogen peroxide reaction. The preferred bleaching agents are those which convert the silver image into silver chloride or silver ferrocyanide and include potassium chloride/chromic acid and potassium ferricyanide. The resulting silver-salt-image formed by the three process steps is an extremely active image for hydrogen peroxide amplification.

The fourth stage of the process consists in developing the silver salt image by a suitable developing agent in the presence of hydrogen peroxide. When the developing agent is a color developing agent, a color coupler must be present in order for dye formation. The color coupler may be present in the emulsion of the photographic element and/or in the developing solution. The color coupler should be present in an amount in excess of the silver content of the photographic element. When the developing agent is a dye forming developing agent which itself forms a dye directly on oxidation by a silver salt, color couplers are not required. The hydrogen peroxide may be present in the same solution as the developing agent or may be in a separate bath with which the photographic element is contacted immediately before or after contact with the developing agent.

The silver salt image formed by the third stage of the process of the invention is preferably fogged in order to increase its activity for hydrogen peroxide amplification. The silver salt may be fogged by exposure to light prior to or during the development in the presence of hydrogen peroxide or a chemical fogging agent; e.g., N-acetyl-N'-phenyl hydrazine, may be included in the treatment bath containing the developing agent or hydrogen peroxide.

The process of the invention may be used to produce black dye images and colored images. In the case of colored images it is desirable to remove the silver from the photographic element by a bleach or bleach-fix step as in the case of conventional color photographic processes.

The invention will now be illustrated by the following Examples.

In the following Examples, the tests were conducted upon a photographic film comprising a coarse grained iodobromide emulsion containing 2 mole percent iodide based on total silver halide content mixed with a dispersion of a cyan coupler (2-(α-(2,4-di-tert-amyl-phenoxy)-butyramido)-4,6-dichloro-5-methyl phenol), such that the coverage of silver was 10 mg/dm$^2$ and that of coupler was 36 mg/dm$^2$.

Strips of the film were exposed to white light behind a continuous wedge.

Processing solutions used in the Examples include:

D19b—a black and white developer available from Kodak Limited having the following formulation:

| | |
|---|---|
| water | 600.0 ml |
| sodium hexametaphosphate | 2.2 g |
| anhydrous sodium sulfite | 2.0 g |
| metol | 2.2 g |
| anhydrous sodium sulfite | 70.0 g |
| hydroquinone | 8.8 g |
| anhydrous sodium carbonate | 48.0 g |
| potassium bromide | 4.0 g |
| water to make | 1 liter |

Amfix—an acid fixer solution available from May and Baker Limited.

Figure 2:
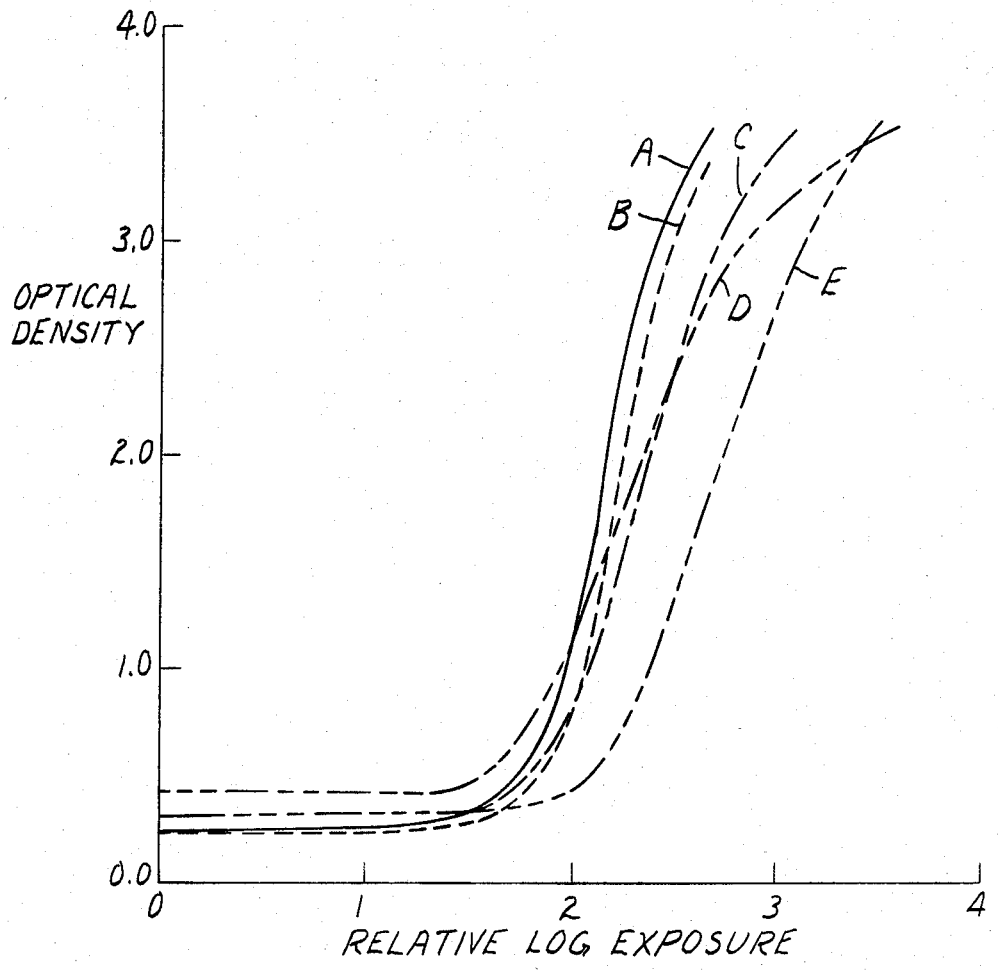
FIG. 2 shows D versus log E curves for products of the present invention.
Figure 3:
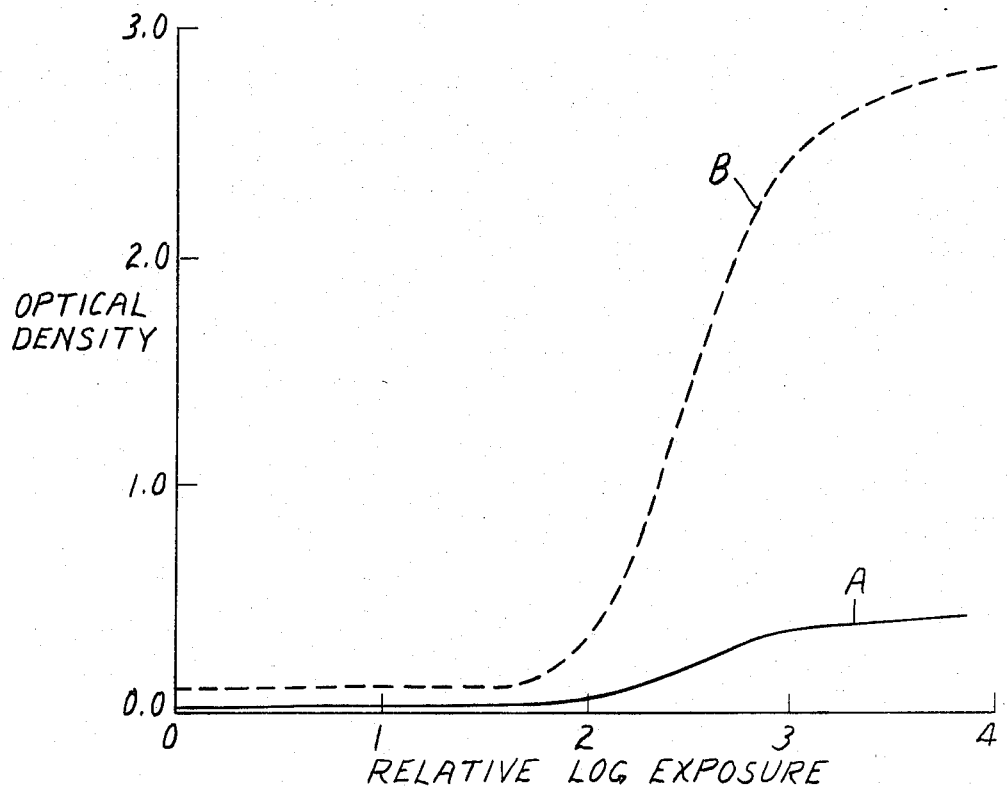
FIG. 3 shows D versus log E curves for a product of the present invention and another product of the invention with a lower silver content.

In the accompanying drawings, FIGS. 1 to 3 represent a plot of image density through a Wratten No. 92, red filter against relative Log exposure for the films processed by Examples 1 to 11.

EXAMPLE 1 (COMPARISON)

An exposed strip was treated as follows:

(a) black and white developer (D19b) 5 mins.

(b) fix (Amfix) 2 mins.

All solutions at 21° C.

The processed strip displayed low density due to developed silver, as shown in the D log E curve A in FIG. 1.

EXAMPLE 2 (COMPARISON)

An exposed strip was processed as follows:
(a) black and white developer (D19b) 5 mins.
(b) stop bath (3% acetic acid) 30 secs.
(c) amplifier bath 5 mins.
(d) fix (Amfix) 2 mins.
The composition of the amplifier bath was:

| | |
|---|---|
| sodium carbonate | 43 g |
| sodium sulfite | 2 g |
| 4-amino-N,N—diethyl-aniline sulfate | 6 g |
| hydrogen peroxide 30% aqueous | 10 ml |
| water to | 100 ml |

The D log E curve is curve B in FIG. 1. Amplification by the developed silver is very low, whereas fog caused by undeveloped silver bromide is high.

EXAMPLE 3 (COMPARISON)

An exposed strip was processed as follows:
(a) black and white developer (D19b) 5 mins.
(b) fix (Amfix) 2 mins.
(c) wash 5 mins.
(d) amplifier bath (as in Example 2) 5 mins.
The D log E curve taken from this strip is curve C in FIG. 1.

No amplification was observed owing to poisoning by the fixer.

EXAMPLE 4 (INVENTION)

An exposed strip was treated as follows:
(a) black and white developer (D19b) 5 mins.
(b) fix (Amfix) 2 mins.
(c) bleach bath 30 secs.
(d) wash 2 mins. (in white light)
(e) amplifier bath (as in Example 2) 3 mins.
The bleach bath contained:

| | |
|---|---|
| chromium trioxide | 20 g |
| potassium chloride | 10 g |
| water to | 1000 ml |

The D log E curve taken from this strip is curve D in FIG. 1 showing high amplification and log fog.

EXAMPLE 5 (COMPARISON)

An exposed strip was processed as Example 4 except that the hydrogen peroxide was omitted from the amplifier bath formulation. In this case the amplifier bath acts solely as a color developer. The D log E curve taken from this strip is curve E in FIG. 1. It is apparent that much less dye density is formed since only the color developer which has been oxidized by the silver salt is available for image formation.

EXAMPLE 6 (INVENTION)

An exposed strip was processed as in Example 4, except that all processing steps were carried out in the dark and 0.5 g per liter of a fogging agent, N-acetyl-N'-phenyl hydrazine, were added to the amplifying bath. A good amplified image was obtained and the D log E curve is curve A in FIG. 2.

EXAMPLE 7 (INVENTION)

An exposed strip was processed as in Example 6 except that a bleach bath consisting of 10% aqueous potassium ferricyanide was used (20 mins.) in place of the chromic acid bleach. A good amplified image was obtained. The D log E curve is curve B in FIG. 2.

EXAMPLE 8 (INVENTION)

An exposed strip was processed as in Example 6 except that a bleach bath consisting of:

| | |
|---|---|
| cobalt hexa-amine triacetate | 4 g |
| potassium chloride | 10 g |
| hydrogen peroxide 30% | 10 g |
| water | 1000 ml |
| pH adjusted to 4.2 with acetic acid | |

was used (15 hours) in place of the chromic acid bleach. Under these conditions cobalt (II) does not remain image-wise in the layer. A good amplified image was obtained and the D log E curve C in FIG. 2.

EXAMPLE 9 (INVENTION)

An exposed strip was processed as in Example 6 except that a bleach bath consisting of:

| | |
|---|---|
| potassium ferricyanide | 200 g |
| potassium bromide | 10 g |
| water | 1000 ml |

was used (30 seconds) in place of the chromic acid bleach. The D log E curve of the amplified image is curve D in FIG. 2.

EXAMPLE 10 (INVENTION)

A coating was prepared of silver halide emulsion identical to that used in Examples 1 to 9, except that no color coupler dispersion was added. A strip of this material was exposed behind a continuous wedge and processed as in Example 6, except that a soluble color coupler (2,4-dichloro-naphthol), 6 g/liter, was added to the amplifying bath. A good amplified image was obtained and the D log E curve is curve E in FIG. 2.

EXAMPLE 11

A photographic element having a low silver halide (1 gram/meter$^2$ of silver) and a conventional X-ray film containing 7 gram/meter$^2$ of silver were exposed to white light behind a continuous wedge and processed in a 3M type XP507 processor giving a 90 seconds dry to dry time. The developer used as 3M XAD90, a high temperature rapid access developer containing phenidone, hydroquinone and hardener, at 35° C. for 25 seconds and the fixer used was 3M XAF, an acid hardener fixer at 27° C. for 25 seconds.

In FIG. 3, curve A represents the optical density obtained from the low silver photographic element and curve B represents the optical density obtained from the conventional X-ray film. It is apparent that a very low optical density is obtained with the low silver photographic element.

It is readily seen by comparison of curve B in FIG. 3 with those curves in FIGS. 1 and 2 which are obtained in accordance with the invention, that optical densities greater than those obtained conventionally using photographic elements containing 7 gram/meter$^2$ of silver may be obtained by the process of the invention from a film containing only 1 gram/meter$^2$ of silver.

I claim:

1. A photographic process for the development of an image-wise exposed silver halide photographic element which comprises treating said element with a developer solution to form a silver image, treating the developed element with fixer to remove undeveloped silver halide, oxidizing the fixed silver image to form a substantially insoluble silver salt and thereafter treating the element with:

(i) color developer and hydrogen peroxide in the presence of a color coupler, or (ii) a dye-forming developing agent, and hydrogen peroxide to form a dye in said imaged areas.

2. A process as claimed in claim 1, in which the substantially insoluble silver salt is fogged prior to and/or during further treatment.

3. A process as claimed in claim 2, in which said fogging is effected by light.

4. A process as claimed in claim 2, in which said fogging is effected by treatment with a chemical fogging agent.

5. A process as claimed in claim 4, in which the photographic element includes a color coupler.

6. A process as claimed in claim 5, in which the color coupler is in an amount in excess of the silver content of the photographic element.

7. A process as claimed in claim 4, in which the substantially insoluble silver salt in the imaged areas is treated with a bath comprising a color developing agent and a color coupler.

8. A process as claimed in claim 1, in which the substantially insoluble silver salt in the imaged areas is treated with a bath comprising hydrogen peroxide and a color developer or dye-forming developing agent.

9. A process as claimed in claim 4, in which the substantially insoluble silver salt in the imaged areas is treated with two separate baths, one bath containing a color developer or dye-forming developing agent and the other bath containing hydrogen peroxide.

10. A process as claimed in claim 1, in which the silver image is oxidized to silver chloride or silver ferrocyanide.

* * * * *